US006070563A

United States Patent [19]

Achenbach et al.

[11] Patent Number: 6,070,563

[45] Date of Patent: Jun. 6, 2000

[54] CRANKCASE OF AN INTERNAL COMBUSTION ENGINE

[75] Inventors: Karl-Jörg Achenbach, Biedenkopf; Ulrich Bertsch, Burgstetten; Thomas Hardt, Weinstadt; Hubert Schnüpke; Günther Zoll, both of Stuttgart, all of Germany

[73] Assignee: DaimlerChrysler AG, Stuttgart, Germany

[21] Appl. No.: 09/299,194

[22] Filed: Apr. 23, 1999

[30] Foreign Application Priority Data

Apr. 25, 1998 [DE] Germany ..... 198 18 593

[51] Int. Cl.[7] ..... F02F 7/00

[52] U.S. Cl. ..... 123/195 R; 123/195 C

[58] Field of Search ..... 123/195 R, 195 C

[56] References Cited

U.S. PATENT DOCUMENTS

| | | | |
|---|---|---|---|
| 5,492,086 | 2/1996 | Kuhns | 123/195 C |
| 5,501,189 | 3/1996 | Van Bezeij | 123/195 R |
| 5,934,686 | 8/1999 | Ottenschlager | 123/195 C |

FOREIGN PATENT DOCUMENTS

| | | |
|---|---|---|
| 26 12 182 | 10/1976 | Germany . |
| 29 16 277 | 10/1980 | Germany . |
| 2 140 502 | 11/1984 | Germany . |

*Primary Examiner*—John Kwon
*Attorney, Agent, or Firm*—Klaus J. Bach

[57] ABSTRACT

In an engine block of an internal combustion engine having a clutch housing provided with cut-outs, a thin-walled liner is fitted into the clutch housing to cover the cut-outs so as to provide a clutch housing structure of a relatively low weight.

6 Claims, 2 Drawing Sheets

CRANKCASE OF AN INTERNAL COMBUSTION ENGINE

BACKGROUND OF THE INVENTION

The invention relates to an engine block of an internal combustion engine with a clutch housing incorporated therein.

Such an engine block is known for example from DE 29 16 277 A1. In this engine block, the noise emissions toward the rear, that is, toward the transmission mounted thereon is reduced by mounting the clutch housing by way of elastomer intermediate layers and covering the clutch additionally by a shell reducing the transmission of noise.

It is the object of the present invention to reduce the noise emission from an engine block and, at the same time, to reduce the weight of an engine block.

SUMMARY OF THE INVENTION

In an engine block of an internal combustion engine having a clutch housing provided with cut-outs, a thin-walled liner is fitted into the clutch housing to cover the cut-outs so as to provide a clutch housing structure of a relatively low weight.

With the openings provided in the clutch housing the weight of the clutch housing is substantially reduced. Furthermore, the thin clutch housing liner substantially reduces noise emission from the clutch. Since the liner is not subjected to any forces, it is thin-walled and therefore lightweight. Preferably, it consists of a plastic material, but it may also consist of a thin-wall metal sheet particularly of a light metal.

The central opening of the clutch Liner may be surrounded by an opening in which a crankshaft seal is disposed. In this way, the mounting of the seal, which is otherwise mounted in the clutch housing, that is the engine block, is facilitated.

The liner may be mounted to the clutch housing in an area surrounding the central opening and by a circumferential flange, which is firmly clamped between a circumferential surface area of the clutch housing and a transmission housing mounted to the clutch housing. If the liner consists of a plastic material also the noise transmission to the transmission housing is reduced.

Normally, a starter is flanged to the engine block which starter cooperates with a gear rim on the clutch or a flywheel associated with the clutch. In that case, the liner has a cutout at its outer circumference through which the starter or rather the starter pinion extends.

It is pointed out that the term clutch has been and will be used. However, if the transmission connected to the engine is an automatic transmission, a torque converter or hydraulic clutch takes the place of the clutch. The expression clutch is therefore intended to include also a hydraulic clutch or a torque converter.

An embodiment of the invention will be described below on the basis of the accompanying drawings.

DESCRIPTION OF A PREFERRED EMBODIMENT

Figure 1:
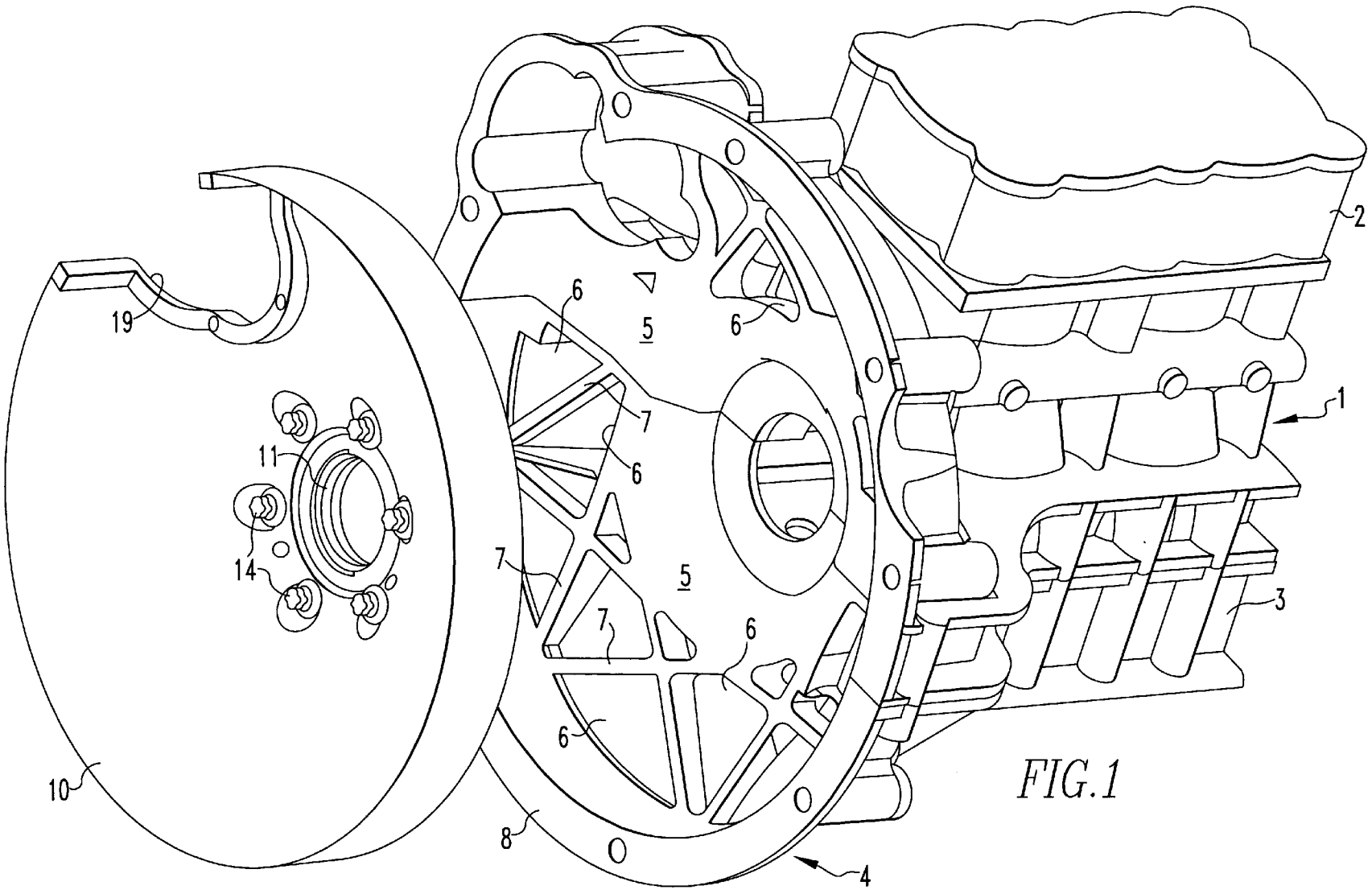
FIG. 1 is a perspective partially exploded view of an engine block with a clutch housing and a liner to be disposed in the clutch housing.

The engine block as shown in FIG. 1 comprises an upper part 1 with a cylinder block 2 and a lower crankcase part 3. The upper and lower parts are each provided with a half clutch housing 4, which has a front wall 5 provided with a plurality of openings 6 for reducing the weight of the clutch housing. The openings are separated by webs, which reinforce the circumferential flange 8 of the clutch housing 4. The clutch housing 4 includes a recess 9 for receiving a pinion of a starter which however is not shown.

Figure 2:
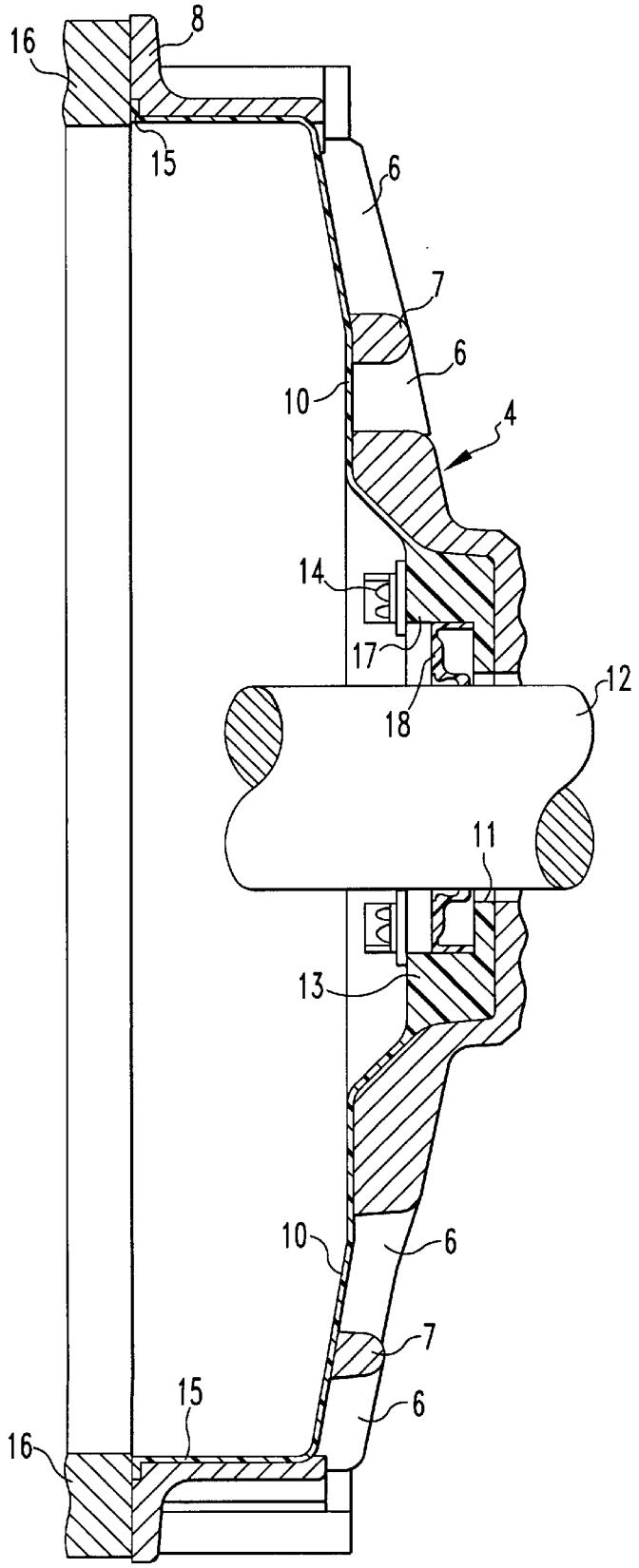
FIG. 2 is a cross-sectional view of the clutch housing with the liner installed in the clutch housing.

For covering the openings 6, a liner 10 is installed in the clutch housing 4, which is shown in detail in FIG. 2 and which includes a central opening 11 through which the crank-shaft 12 extends. The liner 10 is thin-walled and includes a reinforced thickened area 13 so that it can be safely bolted to the clutch housing 4 by bolts 14. At its outer circumference, the liner 10 has a radially outwardly extending edge 15, which is clamped between the circumferential flange 8 of the clutch housing 4 and a flange 16 of a transmission housing bolted to the clutch housing 4.

The central opening 11 is surrounded by an opening wall 17 in which a crankshaft seal 18 is mounted.

In alignment with the recess 9 ir the clutch housing 4, there is provided in the liner 10 an opening 19 through which the starter or respectively, the starter pinion extends in order to engage a gear ring which is normally disposed on the clutch or a flywheel connected thereto.

The liner 10 consists preferably of plastic material. Because of its small wall thickness of, for example, 1–1.5 mm, its weight is very low and the space needed to accommodate the liner is negligible.

What is claimed is:

1. An engine block of an internal combustion engine including a clutch housing provided with cut-outs and a thin-walled liner having a shape corresponding to the shape of said clutch housing and being disposed in said clutch housing to cover said cutouts and having a central opening for receiving an engine crankshaft.

2. An engine block according to claim 1, wherein said liner consists of a plastic material.

3. An engine block according to claim 1, wherein said liner consists of a thin metal sheet.

4. An engine block according to claim 1, wherein said central opening is surrounded by a wall surface in which a crank-shaft seal is mounted.

5. An engine block according to claim 1, wherein said liner is bolted to said clutch housing at its inner circumference defining said central opening and, at its outer circumference, said liner includes a rim extending radially outwardly and being clamped between said clutch housing and a flange of a transmission housing bolted to said clutch housing.

6. An engine according to claim 1, wherein said liner includes a recess with a starter opening formed in its outer circumference for receiving a starter pinion projecting through said starter opening into engagement with a gear ring connected to said clutch.

* * * * *